US011444369B1

(12) United States Patent
Tseng et al.

(10) Patent No.: US 11,444,369 B1
(45) Date of Patent: Sep. 13, 2022

(54) ANTENNA STRUCTURE

(71) Applicant: Quanta Computer Inc., Taoyuan (TW)

(72) Inventors: Yi-Ling Tseng, Taoyuan (TW); Chin-Lung Tsai, Taoyuan (TW); Chung-Ting Hung, Taoyuan (TW); Kuan-Hsien Lee, Taoyuan (TW); Ying-Cong Deng, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 4 days.

(21) Appl. No.: 17/328,870

(22) Filed: May 24, 2021

(30) Foreign Application Priority Data

Apr. 27, 2021 (TW) ..... 110115025

(51) Int. Cl.

| | |
|---|---|
| ***H01Q 1/24*** | (2006.01) |
| ***H01Q 5/371*** | (2015.01) |
| ***H01Q 9/26*** | (2006.01) |
| ***H01Q 1/38*** | (2006.01) |

(52) U.S. Cl.
CPC ..... *H01Q 1/243* (2013.01); *H01Q 1/38* (2013.01); *H01Q 5/371* (2015.01); *H01Q 9/26* (2013.01)

(58) Field of Classification Search
CPC .. H01Q 1/24; H01Q 5/37; H01Q 1/38; H01Q 9/26
See application file for complete search history.

(56) References Cited

U.S. PATENT DOCUMENTS

2016/0149290 A1* 5/2016 Park ..... H01Q 1/44 343/702
2018/0026341 A1* 1/2018 Mow ..... H01Q 21/065 343/702

FOREIGN PATENT DOCUMENTS

TW I668914 B 8/2019

OTHER PUBLICATIONS

Chinese language office action dated Oct. 20, 2021, issued in application No. TW 110115025.

* cited by examiner

*Primary Examiner* — Andrea Lindgren Baltzell
(74) *Attorney, Agent, or Firm* — McClure, Qualey & Rodack, LLP

(57) ABSTRACT

An antenna structure includes a metal mechanism element, a first radiation element, a second radiation element, a third radiation element, and a dielectric substrate. The metal mechanism element has a slot with a first closed end and a second closed end. The first radiation element has a feeding point. The second radiation element is coupled to the feeding point. The second radiation element and the first radiation element substantially extend away from each other. The third radiation element is coupled to a ground voltage. The third radiation element extends across the slot of the metal mechanism element. The dielectric substrate has a first surface and a second surface opposite to each other. The first radiation element, the second radiation element, and the third radiation element are disposed on the first surface of the dielectric substrate. The second surface of the dielectric substrate is adjacent to the slot.

10 Claims, 5 Drawing Sheets

ANTENNA STRUCTURE

CROSS REFERENCE TO RELATED APPLICATIONS

This application claims priority of Taiwan Patent Application No. 110115025 filed on Apr. 27, 2021, the entirety of which is incorporated by reference herein.

BACKGROUND OF THE INVENTION

Field of the Invention

The disclosure generally relates to an antenna structure, and more particularly, it relates to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient bandwidth, it will affect the communication quality of the mobile device. Accordingly, it has become a critical challenge for antenna designers to design a wideband antenna element that is small in size.

BRIEF SUMMARY OF THE INVENTION

In an exemplary embodiment, the disclosure is directed to an antenna structure that includes a metal mechanism element, a first radiation element, a second radiation element, a third radiation element, and a dielectric substrate. The metal mechanism element has a slot. The slot has a first closed end and a second closed end. The first radiation element has a feeding point. The second radiation element is coupled to the feeding point. The second radiation element and the first radiation element substantially extend away from each other. The third radiation element is coupled to a ground voltage. The third radiation element extends across the slot of the metal mechanism element. The dielectric substrate has a first surface and a second surface which are opposite to each other. The first radiation element, the second radiation element, and the third radiation element are disposed on the first surface of the dielectric substrate. The second surface of the dielectric substrate is adjacent to the slot of the metal mechanism element.

In some embodiments, the antenna structure includes a shorting element. The third radiation element is coupled through the shorting element to the ground voltage, and the ground voltage is provided by the metal mechanism element.

In some embodiments, the first radiation element substantially has a first straight-line shape. The first vertical projection of the first radiation element at least partially overlaps the slot of the metal mechanism element.

In some embodiments, the second radiation element substantially has a second straight-line shape. The second vertical projection of the second radiation element at least partially overlaps the slot of the metal mechanism element.

In some embodiments, the third radiation element substantially has a third straight-line shape. The third vertical projection of the third radiation element at least partially overlaps the slot of the metal mechanism element.

In some embodiments, the antenna structure covers a first frequency band from 600 MHz to 960 MHz, and a second frequency band from 1710 MHz to 2170 MHz.

In some embodiments, the length of the slot of the metal mechanism element is substantially equal to 0.5 wavelength of the first frequency band.

In some embodiments, the length of the first radiation element is substantially equal to 0.25 wavelength of the second frequency band.

In some embodiments, the length of the second radiation element is substantially equal to 0.25 wavelength of the second frequency band.

In some embodiments, the length of the third radiation element is from 12 mm to 22 mm.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
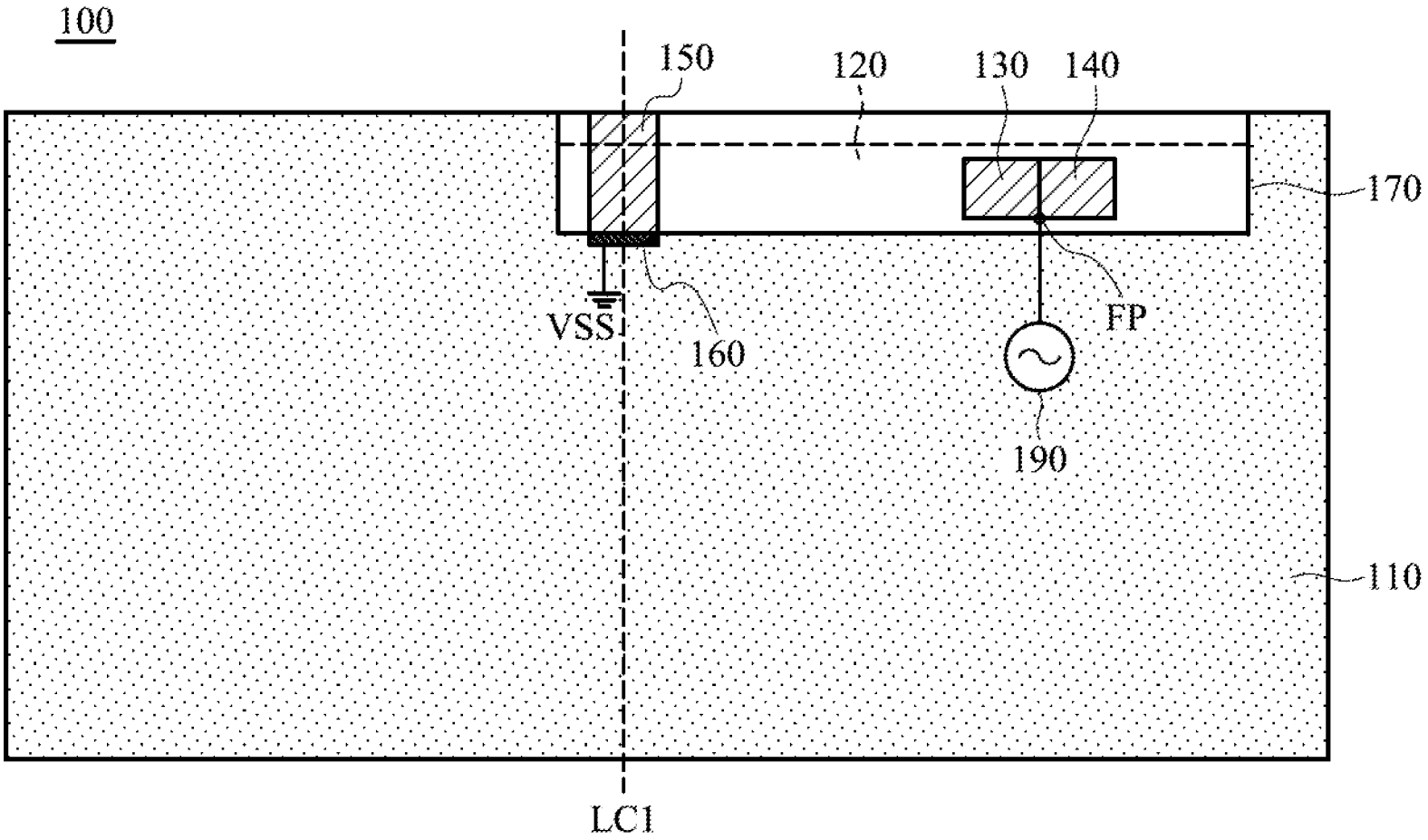
FIG. 1 is a perspective view of an antenna structure according to an embodiment of the invention.

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Furthermore, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 2:
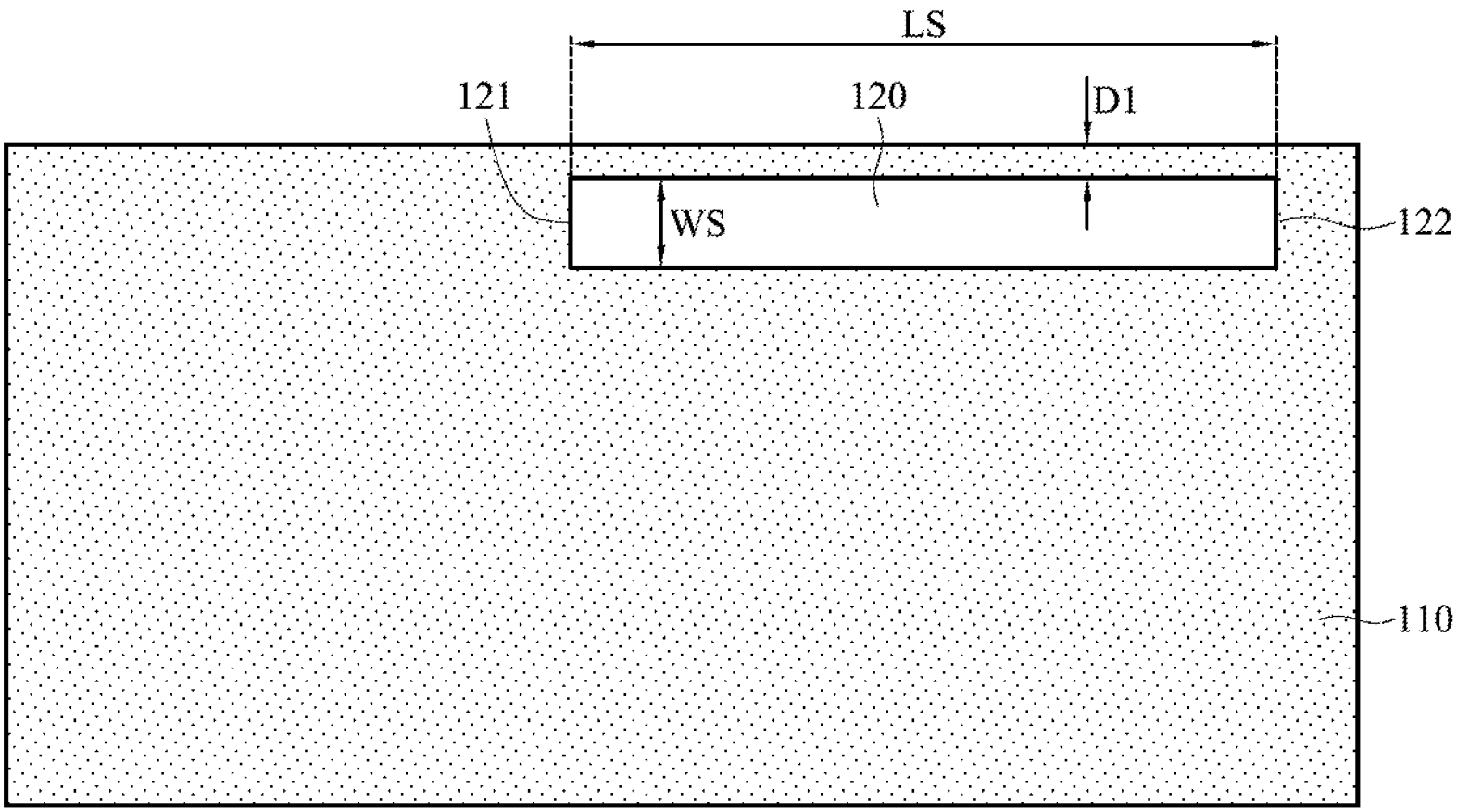
FIG. 2 is a view of lower-layer portions of an antenna structure according to an embodiment of the invention.
Figure 3:
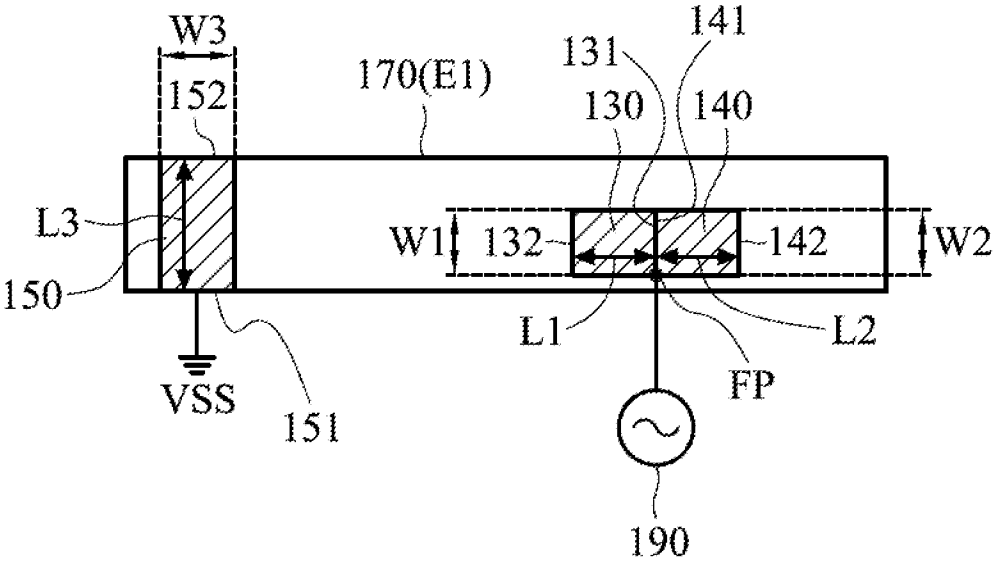
FIG. 3 is a view of upper-layer portions of an antenna structure according to an embodiment of the invention.
Figure 4:
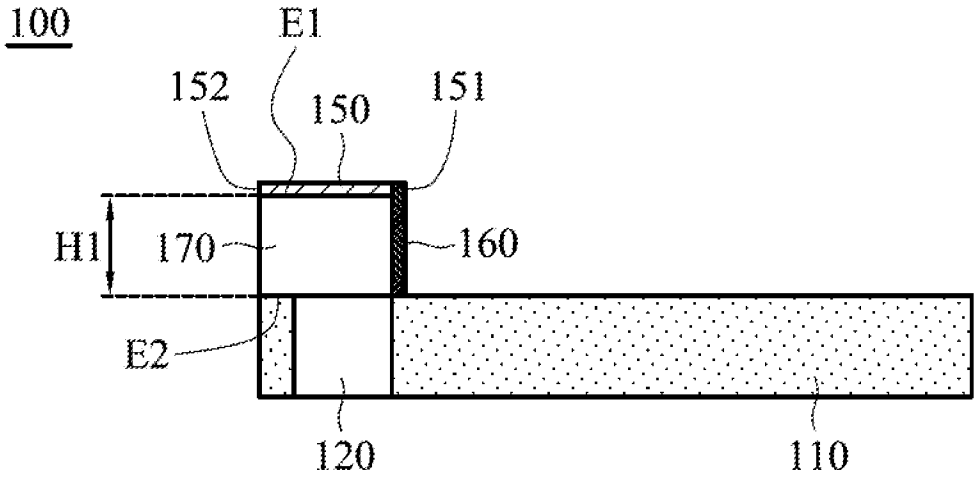
FIG. 4 is a sectional view of an antenna structure according to an embodiment of the invention.

FIG. 1 is a perspective view of an antenna structure 100 according to an embodiment of the invention. FIG. 2 is a view of lower-layer portions of the antenna structure 100 according to an embodiment of the invention. FIG. 3 is a view of upper-layer portions of the antenna structure 100 according to an embodiment of the invention. FIG. 4 is a sectional view of the antenna structure 100 according to an embodiment of the invention (along a sectional line LC1 of FIG. 1). Please refer to FIG. 1, FIG. 2, FIG. 3, and FIG. 4 together to understand the invention. The antenna structure 100 may be applied in a mobile device, such as a smartphone, a tablet computer, a notebook computer, or a system for POS (Point of Sale). In the embodiment of FIG. 1, FIG. 2, FIG. 3, and FIG. 4, the antenna structure 100 includes a metal mechanism element 110, a first radiation element 130, a second radiation element 140, a third radiation element 150, and a dielectric substrate 170.

The metal mechanism element 110 may be an appearance element of a mobile device.

It should be noted that the term "appearance element" as used in the disclosure refers to a portion of the mobile device that can be seen directly by the user. In some embodiments, the metal mechanism element 110 is a metal upper cover of a notebook computer, or a metal back cover of a tablet computer, but it is not limited thereto. For example, if the mobile device is a notebook computer, the metal mechanism element 110 may be what is called an "A-component" in the field of notebook computers. In alternative embodiments, the metal mechanism element 110 may be an internal component of the mobile device, and it therefore cannot be seen by the user. The metal mechanism element 110 has a slot 120. The slot 120 of the metal mechanism element 110 may substantially have a straight-line shape. The slot 120 may be substantially parallel to an edge 111 of the metal mechanism element 110. Specifically, the slot 120 may be a closed slot with a first closed end 121 and a second closed end 122 which are away from each other. The antenna structure 100 may also include a nonconductive material which fills the slot 120 of the metal mechanism element 110, so as to provide effective waterproofing or dustproofing. It should be noted that since the closed slot 120 does not form any notch on the edge 111 of the metal mechanism element 110, the whole robustness of the metal mechanism element 110 can be significantly enhanced.

The first radiation element 130, the second radiation element 140, and the third radiation element 150 may all be made of metal materials, such as copper, silver, aluminum, iron, or their alloys. The dielectric substrate 170 may be an FR4 (Flame Retardant 4) substrate, a PCB (Printed Circuit Board), or an FCB (Flexible Circuit Board). The dielectric substrate 170 has a first surface E1 and a second surface E2 which are opposite to each other. The first radiation element 130, the second radiation element 140, and the third radiation element 150 may all be disposed on the first surface E1 of the dielectric substrate 170. The second surface E2 of the dielectric substrate 170 may be adjacent to the slot 120 of the metal mechanism element 110. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0). In some embodiments, the second surface E2 of the dielectric substrate 170 directly touches the metal mechanism element 110. As a result, the dielectric substrate 170 can almost cover the whole slot 120 of the metal mechanism element 110.

The first radiation element 130 may substantially have a first straight-line shape. Specifically, the first radiation element 130 has a first end 131 and a second end 132. A feeding point FP is positioned at the first end 131 of the first radiation element 130. The second end 132 of the first radiation element 130 is an open end. The feeding point FP may be further coupled to a signal source 190. For example, the signal source 190 may be an RF (Radio Frequency) module for exciting the antenna structure 100. In some embodiments, the first radiation element 130 has a first vertical projection on the metal mechanism element 110, and the first vertical projection at least partially overlaps the slot 120 of the metal mechanism element 110. For example, the whole first vertical projection of the first radiation element 130 may be inside the slot 120 of the metal mechanism element 110, but it is not limited thereto.

The second radiation element 140 may substantially have a second straight-line shape. Specifically, the second radiation element 140 has a first end 141 and a second end 142. The first end 141 of the second radiation element 140 is coupled to the feeding point FP and the first end 131 of the first radiation element 130. The second end 142 of the second radiation element 140 is an open end. The second end 142 of the second radiation element 140 and the second end 132 of the first radiation element 130 may substantially extend in opposite directions and away from each other. In some embodiments, the second radiation element 140 has a second vertical projection on the metal mechanism element 110, and the second vertical projection at least partially overlaps the slot 120 of the metal mechanism element 110. For example, the whole second vertical projection of the second radiation element 140 may be inside the slot 120 of the metal mechanism element 110, but it is not limited thereto. In some embodiments, the length L2 of the second radiation element 140 is slightly shorter than or equal to the length L1 of the first radiation element 130. In alternative embodiments, the length L2 of the second radiation element 140 is slightly longer than the length L1 of the first radiation element 130.

The third radiation element 150 may substantially have a third straight-line shape. Specifically, the third radiation element 150 has a first end 151 and a second end 152. The first end 151 of the third radiation element 150 is coupled to the ground voltage VSS. The second end 152 of the third radiation element 150 is an open end, which extends across the slot 120 of the metal mechanism element 110. In some embodiments, the third radiation element 150 has a third vertical projection on the metal mechanism element 110, and the third vertical projection at least partially overlaps the slot 120 of the metal mechanism element 110. For example, the third vertical projection of the third radiation element 150 may extend beyond the slot 120 of the metal mechanism element 110, but it is not limited thereto. In addition, the second end 152 of the third radiation element 150 may be substantially aligned with the edge 111 of the metal mechanism element 110.

In some embodiments, the antenna structure 100 further includes a shorting element 160. The first end 151 of the third radiation element 150 may be further coupled through the shorting element 160 to the ground voltage VSS. The ground voltage VSS may be provided by the metal mechanism element 110. For example, the shorting element 160 may be implemented with a ground copper foil, a pogo pin, or a metal spring, and its shapes and types are not limited in the invention.

Figure 5:
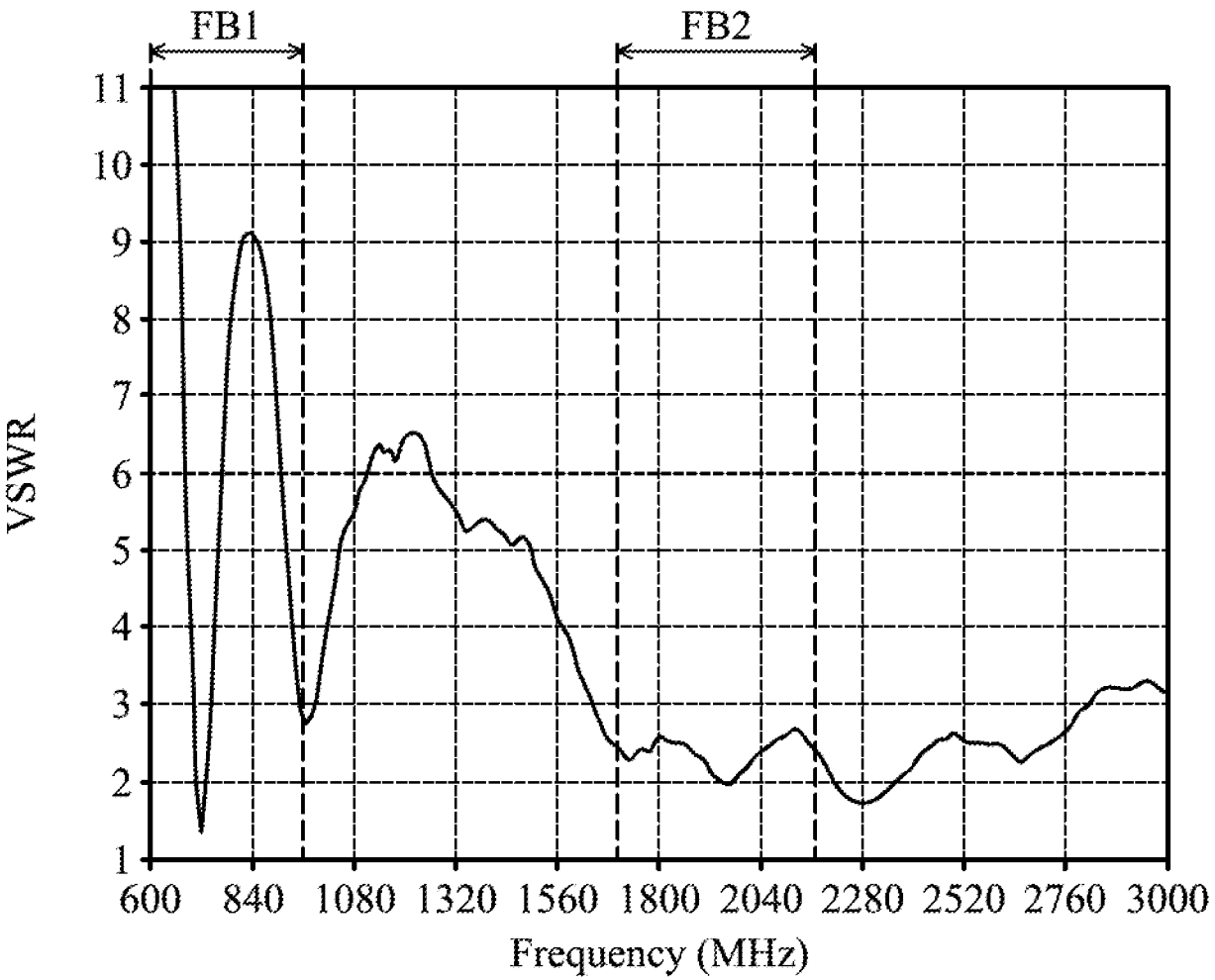
FIG. 5 is a diagram of VSWR (Voltage Standing Wave Ratio) of an antenna structure according to an embodiment of the invention.

FIG. 5 is a diagram of VSWR (Voltage Standing Wave Ratio) of the antenna structure 100 according to an embodiment of the invention. The horizontal axis represents operation frequency (MHz), and the vertical axis represents the VSWR. According to the measurement of FIG. 5, when being excited by the signal source 190, the antenna structure 100 can cover a first frequency band FB1 and a second frequency band FB2. For example, the first frequency band FB1 may be from 600 MHz to 960 MHz, and the second frequency band FB2 may be from 1710 MHz to 2170 MHz. Thus, the antenna structure 100 can support at least the wideband operations of LTE (Long Term Evolution).

In some embodiments, the operation principles of the antenna structure 100 are described as follows. The slot 120 of the metal mechanism element 110 is excited by the first radiation element 130 and the second radiation element 140 using a coupling mechanism, so as to generate the first frequency band FB1. The first radiation element 130 and the second radiation element 140 are excited to generate the second frequency band FB2. In addition, the third radiation element 150 is configured to fine-tune the impedance matching of the first frequency band FB1, thereby increasing the operation bandwidth of the first frequency band FB1.

In some embodiments, the element sizes of the antenna structure 100 are described as follows. The length LS of the slot 120 of the metal mechanism element 110 may be substantially equal to 0.5 wavelength (V2) of the first frequency band FB1 of the antenna structure 100. The width WS of the slot 120 of the metal mechanism element 110 may be from 8 mm to 16 mm, such as about 12 mm. The distance D1 between the edge 111 and the slot 120 of the metal mechanism element 110 may be from 1 mm to 9 mm, such as about 5 mm. The length L1 of the first radiation element 130 may be substantially equal to 0.25 wavelength (V4) of the second frequency band FB2 of the antenna structure 100. The width W1 of the first radiation element 130 may be from 5 mm to 15 mm, such as about 10 mm. The length L2 of the second radiation element 140 may be substantially equal to 0.25 wavelength (V4) of the second frequency band FB2 of the antenna structure 100. The width W2 of the second radiation element 140 may be from 5 mm to 15 mm, such as about 10 mm. The length L3 of the third radiation element 150 may be from 12 mm to 22 mm, such as about 17 mm. The width W3 of the third radiation element 150 may be from 5 mm to 15 mm, such as about 10 mm. The thickness H1 of the dielectric substrate 170 may be from 0.1 mm to 1 mm, such as about 0.4 mm. The above ranges of element sizes are calculated and obtained according to the results of many experiments, and they can help to optimize the operation bandwidth and impedance matching of the antenna structure 100.

The invention proposes a novel antenna structure, which may be integrated with a metal mechanism element. Since the metal mechanism element is considered as an extension portion of the antenna structure, it does not negatively affect the radiation performance of the antenna structure. Compared to the conventional design, the invention has at least the advantages of small size, wide bandwidth, low manufacturing cost, and sufficient robustness, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-5. The invention may merely include any one or more features of any one or more embodiments of FIGS. 1-5. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a metal mechanism element, having a slot, wherein the slot has a first closed end and a second closed end;

a first radiation element, having a feeding point;

a second radiation element, coupled to the feeding point, wherein the second radiation element and the first radiation element substantially extend away from each other;

a third radiation element, coupled to a ground voltage, wherein the third radiation element extends across the slot of the metal mechanism element; and a dielectric substrate, having a first surface and a second surface opposite to each other, wherein the first radiation element, the second radiation element, and the third radiation element are disposed on the first surface of the dielectric substrate, and the second surface of the dielectric substrate is adjacent to the slot of the metal mechanism element.

2. The antenna structure as claimed in claim 1, further comprising:

a shorting element, wherein the third radiation element is coupled through the shorting element to the ground voltage, and the ground voltage is provided by the metal mechanism element.

3. The antenna structure as claimed in claim 1, wherein the first radiation element substantially has a first straight-line shape, and a first vertical projection of the first radiation element at least partially overlaps the slot of the metal mechanism element.

4. The antenna structure as claimed in claim 1, wherein the second radiation element substantially has a second straight-line shape, and a second vertical projection of the second radiation element at least partially overlaps the slot of the metal mechanism element.

5. The antenna structure as claimed in claim 1, wherein the third radiation element substantially has a third straight-line shape, and a third vertical projection of the third radiation element at least partially overlaps the slot of the metal mechanism element.

6. The antenna structure as claimed in claim 1, wherein the antenna structure covers a first frequency band from 600 MHz to 960 MHz, and a second frequency band from 1710 MHz to 2170 MHz.

7. The antenna structure as claimed in claim 6, wherein a length of the slot of the metal mechanism element is substantially equal to 0.5 wavelength of the first frequency band.

8. The antenna structure as claimed in claim 6, wherein a length of the first radiation element is substantially equal to 0.25 wavelength of the second frequency band.

9. The antenna structure as claimed in claim 6, wherein a length of the second radiation element is substantially equal to 0.25 wavelength of the second frequency band.

10. The antenna structure as claimed in claim 1, wherein a length of the third radiation element is from 12 mm to 22 mm.

* * * * *